US007806561B2

(12) United States Patent
Chen

(10) Patent No.: US 7,806,561 B2
(45) Date of Patent: Oct. 5, 2010

(54) INTEGRALLY EMBEDDED AC/DC DOUBLE-HEADED LAMP

(75) Inventor: Chi-Chung Chen, Banqiao (TW)

(73) Assignee: Nano Light Technology Co., Ltd., Banqiao (TW)

( * ) Notice: Subject to any disclaimer, the term of this patent is extended or adjusted under 35 U.S.C. 154(b) by 208 days.

(21) Appl. No.: 12/013,156

(22) Filed: Jan. 11, 2008

(65) Prior Publication Data

US 2009/0141497 A1 Jun. 4, 2009

(30) Foreign Application Priority Data

Jan. 12, 2007 (TW) ..... 96200668 U

(51) Int. Cl.
*F21V 23/02* (2006.01)

(52) U.S. Cl. ..... 362/265; 362/249.11; 362/646; 362/659

(58) Field of Classification Search ..... 362/645, 362/646, 647, 651, 658, 659, 249.11, 265; 315/160

See application file for complete search history.

(56) References Cited

U.S. PATENT DOCUMENTS 4,984,142 A * 1/1991 Garnerone ..... 362/249.01
6,517,219 B1 * 2/2003 Chen ..... 362/349
7,036,962 B2 * 5/2006 Chan ..... 362/407

* cited by examiner

*Primary Examiner*—John A Ward

(57) ABSTRACT

In an integrally embedded AC/DC double-headed lamp, at least one illuminative element is disposed on a lamp board, two sides of the light board are respectively disposed with a conductive terminal used for letting in a lamp seat to electrically connect to the lamp seat and an integrally formed cover body is used to cover the illuminative element directly thereby reducing the processing time and elevating the production efficiency, further attaining to the cost reducing object. Furthermore, the illuminative element is allowed to generate a different illumination effect through a different cover body to provide a user with different illumination and decoration uses.

18 Claims, 12 Drawing Sheets

INTEGRALLY EMBEDDED AC/DC DOUBLE-HEADED LAMP

CROSS-REFERENCES TO RELATED APPLICATIONS

This non-provisional application claims priority under 35 U.S.C. §119(a) on Patent Application No(s). 096200668 filed in Taiwan, R.O.C. on 2007 Jan. 12, the entire contents of which are hereby incorporated by reference.

FIELD OF THE INVENTION

The present invention relates to a double-headed lamp, and more particularly to an integrally embedded AC/DC double-headed lamp.

BACKGROUND

In a decoration of a general festival, stage or hall, for elevating the aesthetic feeling of an illumination source, a festoon lighting sets with multiple lamp holders is usually used, a double-headed lamp is placed into each lamp holder, and the festoon lighting set is respectively wound around ceilings, cupboards, display windows, tables and decorations to allow it to have a continuous long strip light source to attain to the illumination and decoration effects.

As FIGS. 1 and 2 show, two ends of a light bulb A11 of a conventional double-headed lamp structure are respectively put around with a metal engagement head A1 clipping tightly and connected to the light bulb A11 by means of adhesion, a terminal A13 is extended from each engagement head A12 and the terminal A13 is let in a retaining portion A21 of the lamp holder A2 to allow the double-headed lamp A1 to be fixed in the lamp holder A2 to use as an illuminating decoration after the power source is conducted, in which the light bulb A11 is illuminated by conducting electricity to heat tungsten filaments to be incandescent. Besides, the periphery of the light bulb A11 is made from glass and the light bulb A11 is in a vacuum state or filled with inert gas so as to prevent the tungsten filaments from being oxidized under a high temperature.

However, the power source used in the double-headed lamp A1 is AC or DC and the light bulb A11 is taken as an illumination material; this not only shorten the life of the double-headed lamp A1 but also cause it to have the deficits of electricity consumption and high temperature. Besides, not only it needs to process manufacturing more than twice to couple the engagement head A12 to the light bulb A11 but also the engagement head A12 is unable to be coupled to the light bulb A11 tightly to cause the production cost to be higher and the fraction defective not to be lowered down. Moreover, the light bulb A11 of the double-headed lamp A1 is unable to provide various colors to cause the decoration effect to be limited and consequently, the use of the double-headed lamp is limited.

SUMMARY OF THE INVENTION

For improving a structure of a double-headed lamp so as to reduce the processing time and lower the fraction defective as well as further to reduce the production cost, and enabling the double-headed lamp to generate a different illumination effect, the present invention is proposed.

The present invention proposes an integrally embedded AC/DC double-headed lamp, comprising:

a lamp board;

at least one illuminative element, disposed on the lamp board;

a plurality of conductive terminals, respectively positioned on two sides of the lamp board and used for letting in a lamp seat to electrically connect to the lamp seat; and a cover body, formed integrally and covering at least one part of the illuminative element.

The present invention uses an integrated cover body to cover the illuminative element directly so as to reduce the processing time and elevate the production efficiency and further to attain to the cost reducing object. Moreover, a cover body made from a different material allows the illuminative element to generate a different illumination effect so as to provide a user with different illumination and decoration uses.

BRIEF DESCRIPTION OF THE DRAWINGS

The present invention can be more fully understood by reference to the following description and accompanying drawings, in which.

DESCRIPTION OF PREFERRED EMBODIEMENTS

Figure 1:
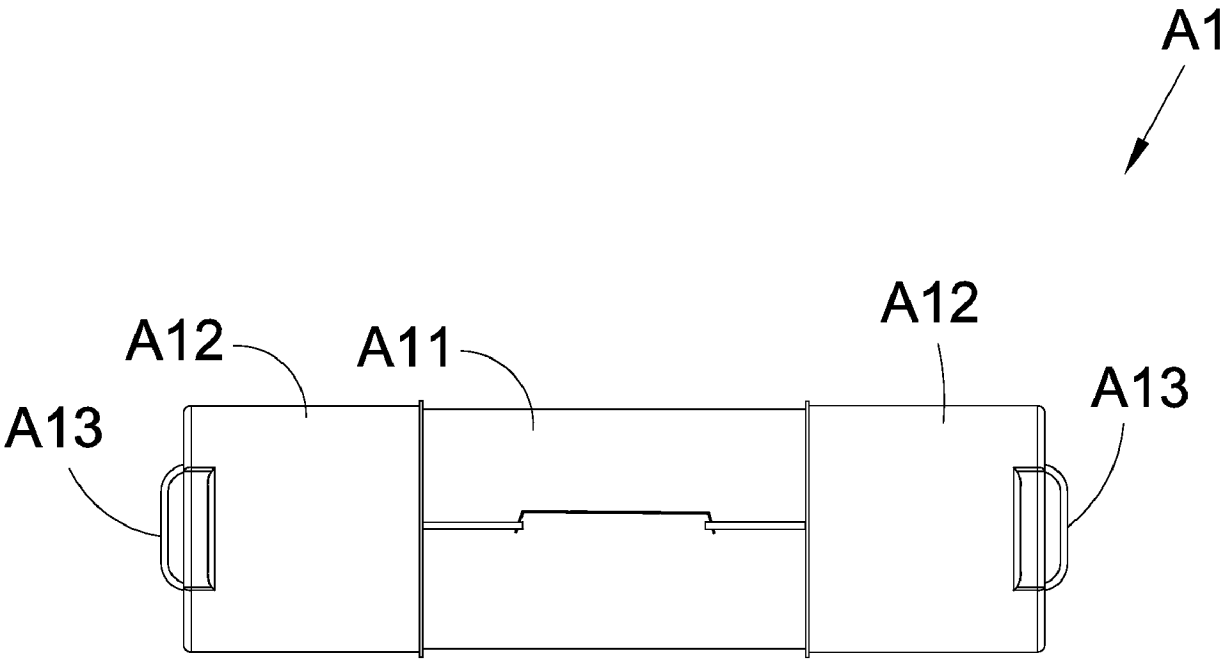
Fig.1 (Prior Art)
FIG. 1 is a plane view of a conventional double-headed lamp.
Figure 2:
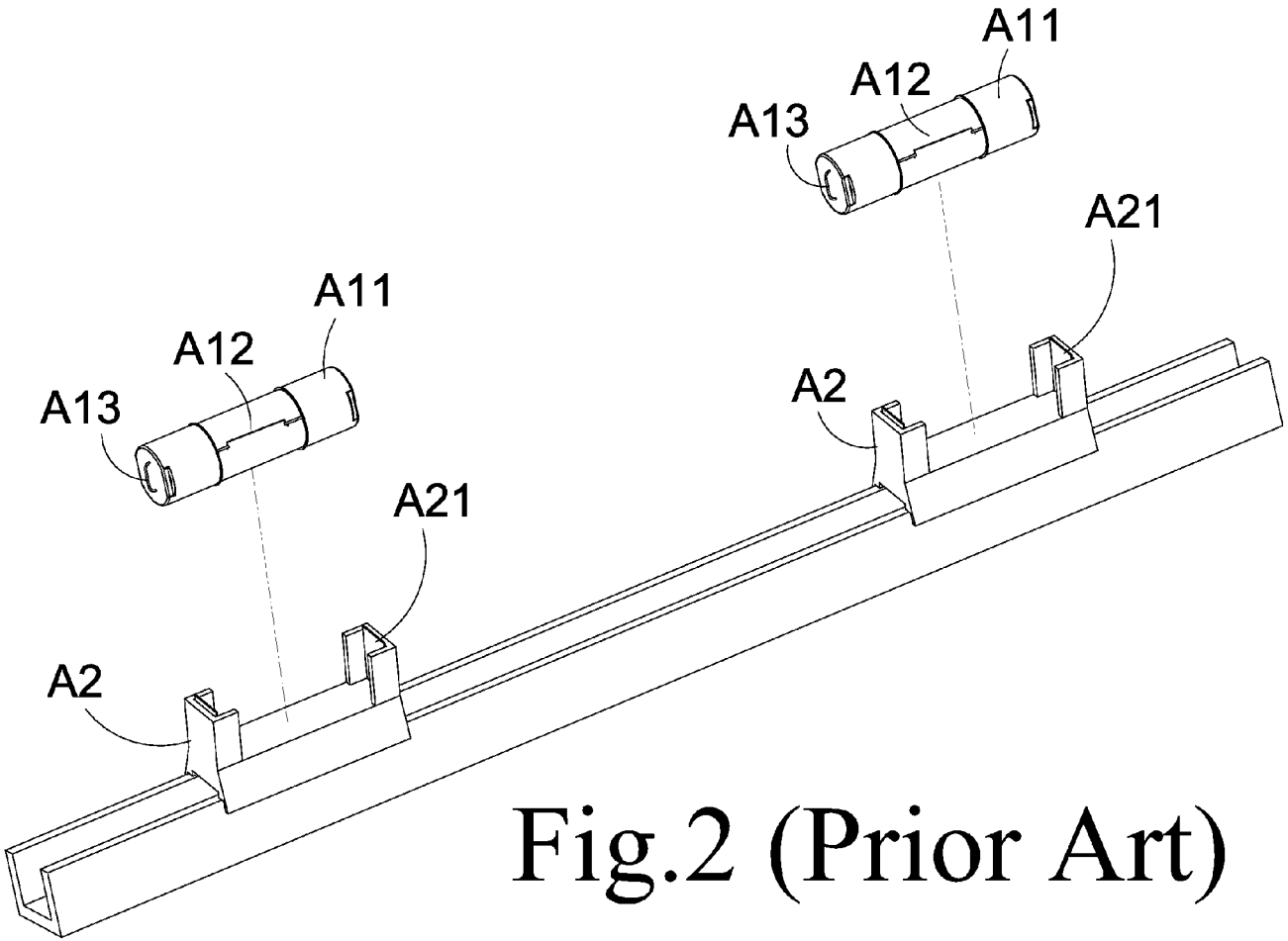
Fig.2 (Prior Art)
FIG. 2 is a perspective view of a conventional double-head lamp.
Figure 3:
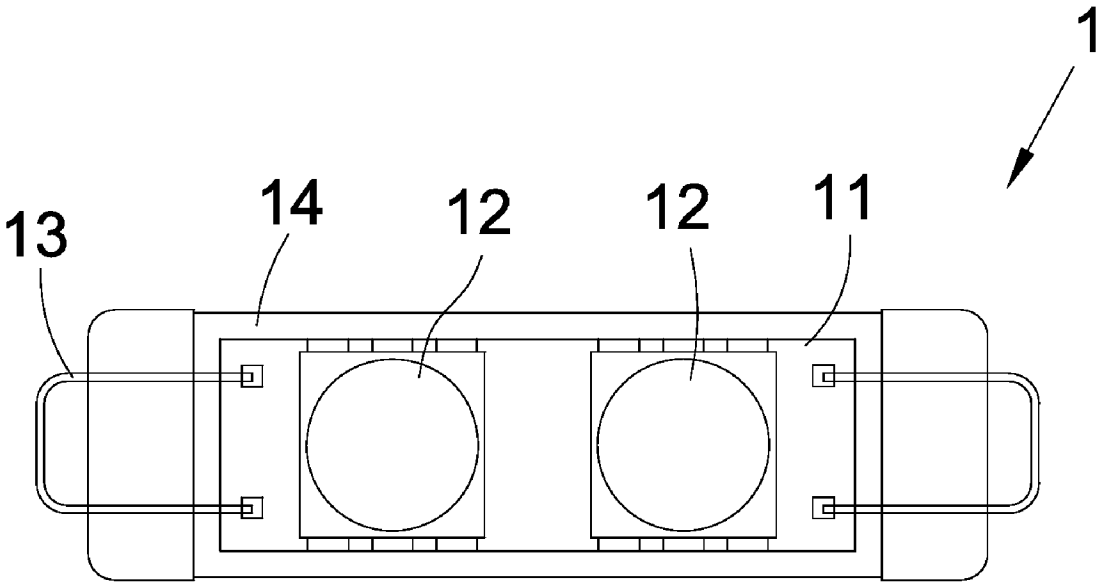
FIG. 3 is a plane view, showing a double-headed lamp of a first preferred embodiment according to the present invention.
Figure 4:
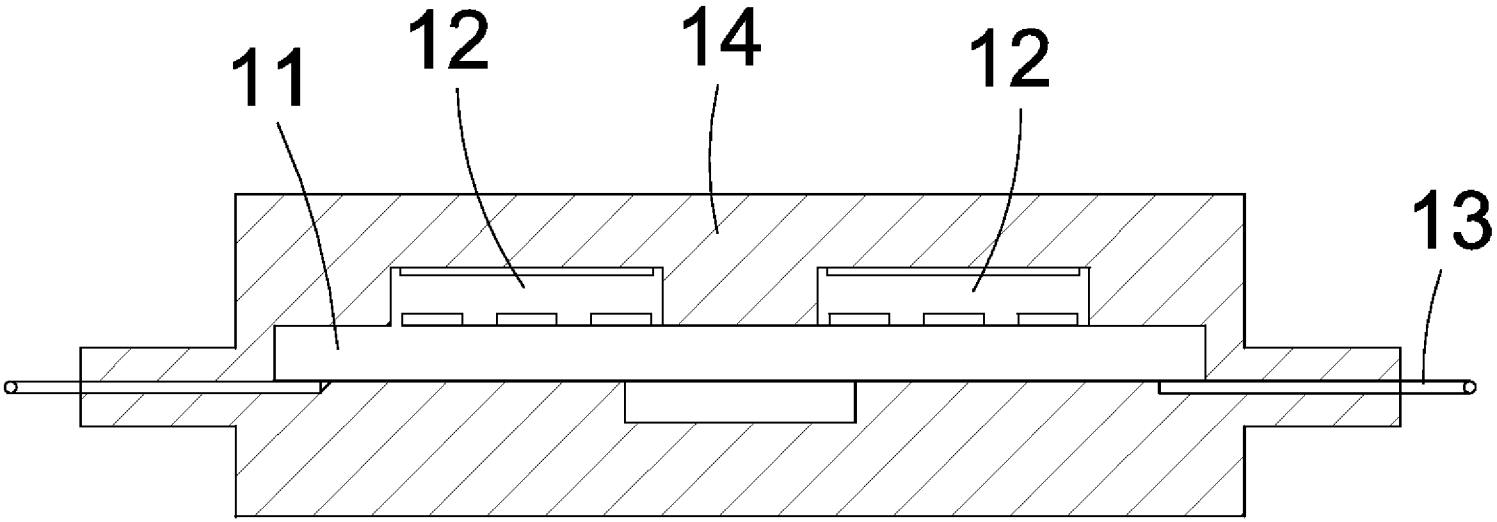
FIG. 4 is a cross sectional view of a double-headed lamp of the first preferred embodiment according to the present invention.
Figure 5:
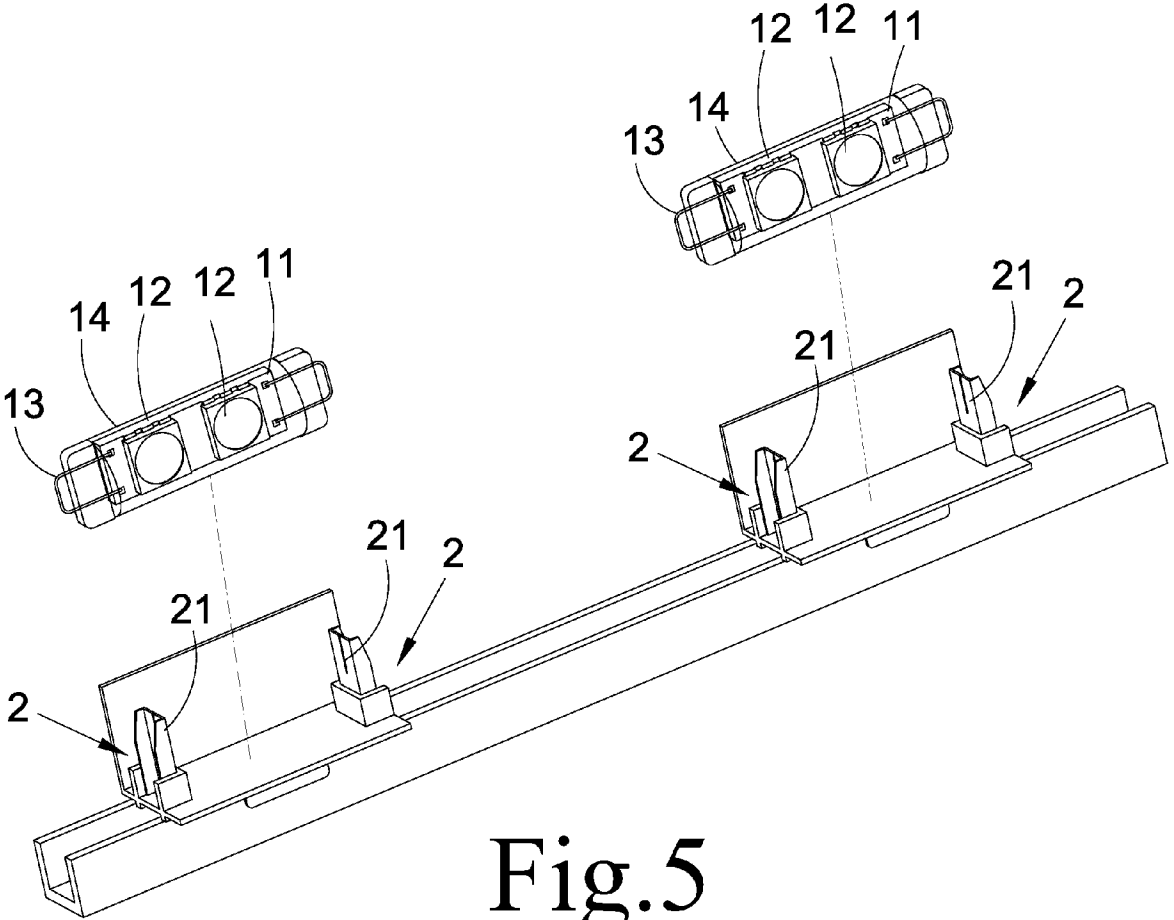
FIG. 5 is a perspective view, showing a double-headed lamp of the first preferred embodiment according to the present invention.
Figure 6:
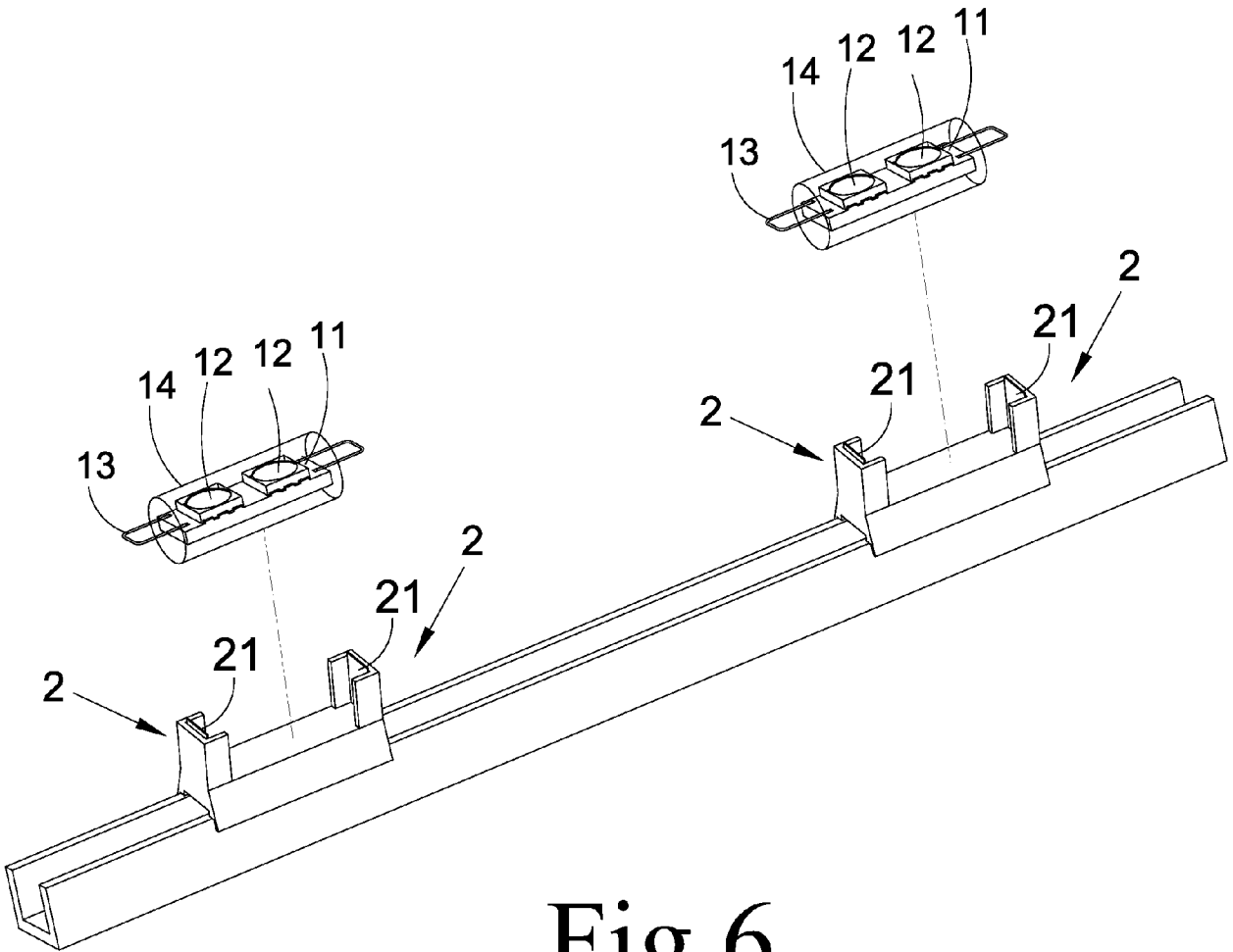
FIG. 6 is a perspective view, showing another double-headed lamp of the first preferred embodiment according to the present invention.

Please refer to FIGS. 3 to 6. FIG. 3 is a plane view, showing a double-headed lamp of a first preferred embodiment according to the present invention. FIG. 4 is a cross sectional view of a double-headed lamp of the first preferred embodiment according to the present invention. FIG. 5 is a perspective view, showing a double-headed lamp of the first preferred embodiment according to the present invention. FIG. 6 is a perspective view, showing another double-headed lamp of the first preferred embodiment according to the present invention.

An integral embedded AC/DC double-headed lamp 1 comprises a lamp board 11, at least one illuminative element 12, a plurality of conductive terminals 13 and a cover body 14.

The lamp board 11 comprises an AC/DC switching circuit used for judging an electricity providing type and providing AC and DC power source outputs.

The illuminative elements 12 are disposed on the lamp board 11. The illuminative elements 12 may be disposed on one face of the lamp board 11 or two faces of the lamp board 11 depending on a practical design need.

According to a structure of the present invention, the illuminative element 12 may be a LED (light emitting diode or a LD (laser diode).

The conductive terminals 13 are respectively disposed on two side of the lamp board 11, and the conductive terminal 13 is U-shaped or inverted U-shaped, Two ends of the conductive terminal 13 are respectively electrically connected to the lamp board 11, and a middle bended part thereof may be let in a retaining portion 21 of a lamp seat 2 to allow the conductive terminal 13 to be electrically connected to the lamp seat 5. Besides, the conductive terminal 13 may be strip-shaped.

The cover body 14 is made integrally to be a solid body and stuffed into the illuminative element 12 to cover it completely to attain to the lamp board 11 partly covered effect. Besides, the cover body 14 may also cover the lamp board 11 and the two ends of the conductive terminal 13 completely so as to protect the lamp board 11, the illuminative elements 12 and connections of the lamp 11 and the conductive terminal 13 from damage while being struck by an external force and allow the conductive terminal 13 to be fixed on the lamp board 11 and not to be released easily. Moreover, that the cover body 14 covers the lamp board 11 can also prevent the lamp board 11 from generating a short circuit.

The cover body 14 mentioned above may made by means of affusion or mold injection. Besides, the cover body 14 may be circular, square, triangular or oval. Moreover, a material of the cover body 14 may be chosen from a group constituted by plastics, rubber, silica gel, epoxy, PMMA and PU, in which the plastics may be acrylic resin, PC. PS, PP or ABS.

When the conductive terminals 13 are respectively let in the retaining portion 21 of the lamp seats 2, the integrally embedded AC/DC double-headed lamp 1 is allowed to fix in the lamp seat 2, and a power source type of the lamp seat 2 is judged through an AC/DC switching circuit of the lamp board 11 to provide a power output to cause the illuminative element 12 to emit light to use for illumination. The cover body 14 is made integrally and directly covers the illuminative elements 12 according to the present invention thereby reducing the processing time and elevating the production efficiency and in the meantime, reducing the fraction defective of product to attain to the cost reducing object.

Furthermore, a user may place the conductive terminals 13 of the double-headed lamp 1 in the lamp seat 2 vertically or in parallel to the lamp seat 2 and allows the conductive terminals 13 to let in the engagement portion 21 of the lamp seat 2 thereby allowing the double-headed lamp 1 to be adapted to a variety of different structures of the lamp seat 2.

In addition, the cover body 14 may be transparent or semi-transparent, may also have a different color such as white, blue, green or red and is collocated with a different color of illuminative element 12 so as to generate various colors of light to have different vision effects to provide a user with a decoration use. Moreover, the cover body 14 may be made by using at least two materials simultaneously to allow a light emitted from the illuminative elements 12 to have at least two colors or effects simultaneously after being projected or reflected through the cover body 14.

In addition, the cover body 14 may have a different hazy face, decorative pattern or air bubbles contained therein to allow the light emitted from the illuminative elements 12 to have an illumination effect with a more particular style and aesthetic perception after being projected or reflected through the cover body 14.

Figure 7:
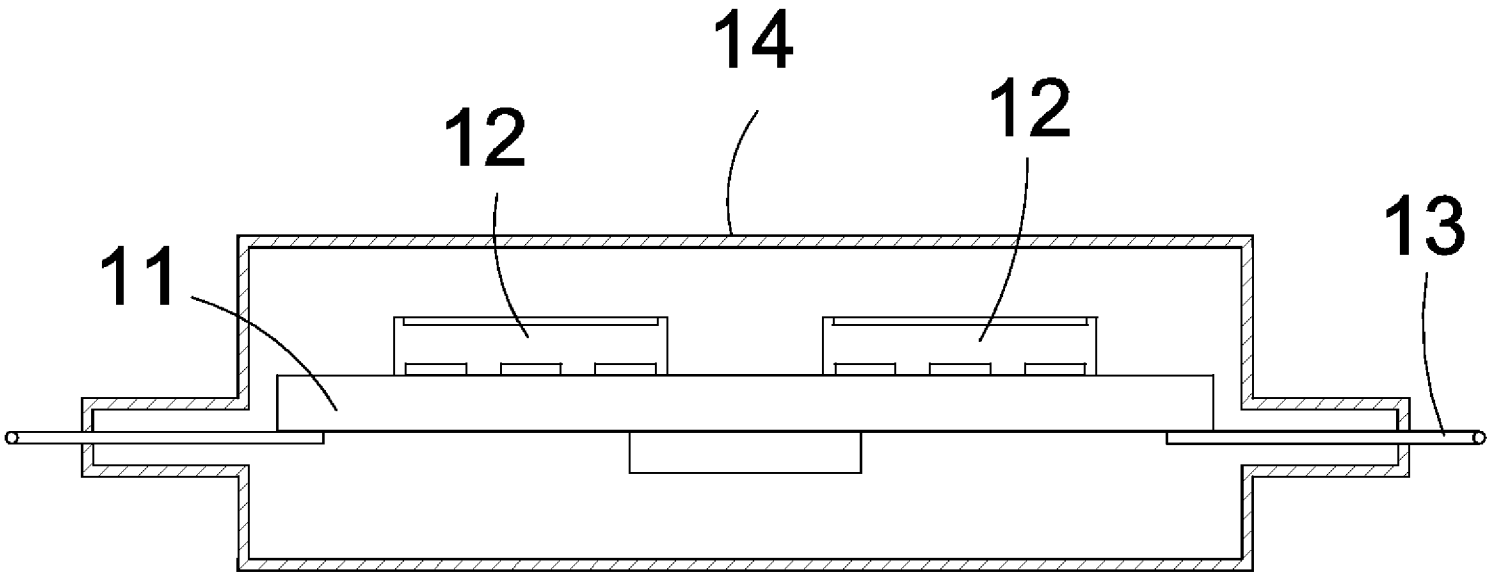
FIG. 7 is a perspective view, showing a double-headed lamp of a second preferred embodiment according to the present invention.

Please refer to FIG. 7. FIG. 7 is a perspective view, showing a double-headed lamp of a second preferred embodiment according to the present invention.

The cover body 14 is a hollow body to cover the illuminative elements 12, the lamp board 11 and the two ends of the conductive terminals 13 completely, and the cover body can be filled with inert gas or general gas so as to protect the lamp board 11, the illuminative elements 12 and the connections of the lamp board 11 and the conductive terminal 13 from being damaged or released easily while being struck by an external force and prevent the lamp board 11 from being generated with a short circuit thereon.

Figure 8:
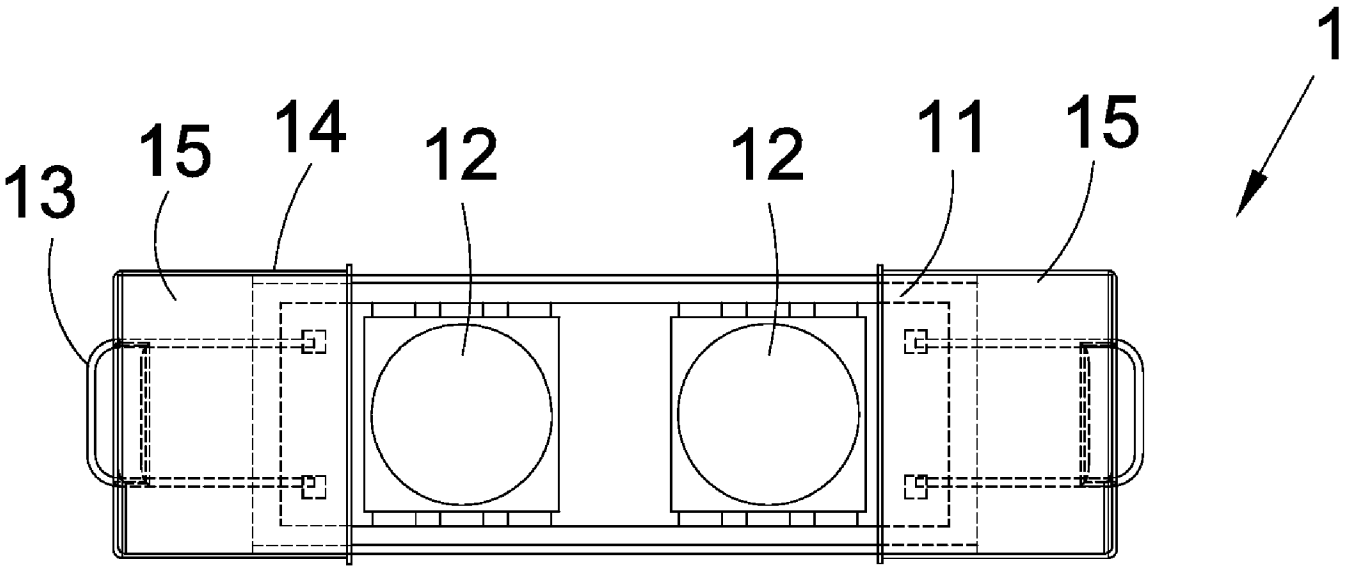
FIG. 8 is a plane view, showing a double-headed lamp of a third preferred embodiment according to the present invention.
Figure 9:
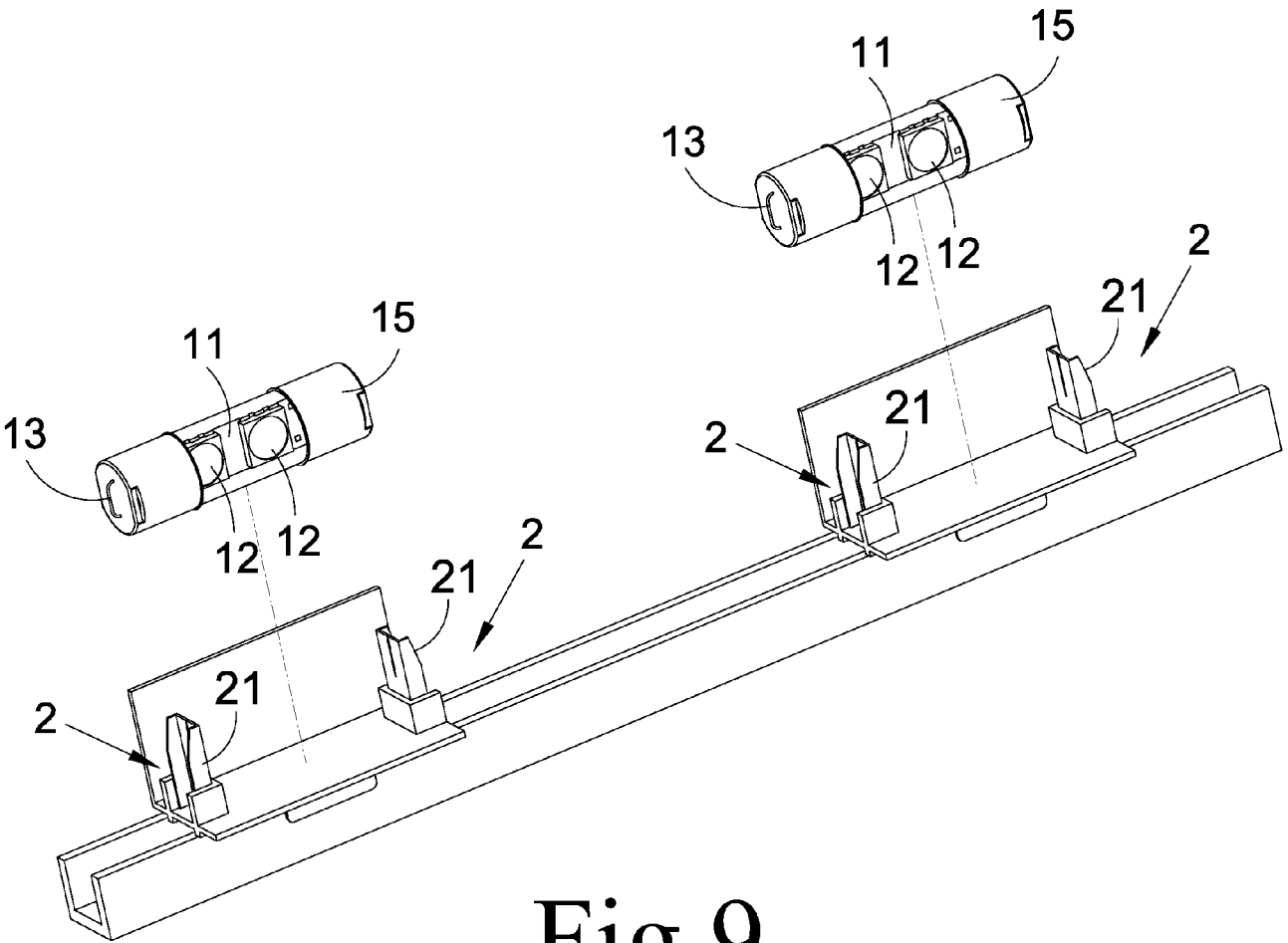
FIG. 9 is a perspective view, showing a double-headed lamp of the third preferred embodiment according to the present invention.

Please refer to FIGS. 8 and 9. FIG. 8 is a plane view, showing a double-headed lamp of a third preferred embodiment according to the present invention. FIG. 9 is a perspective view, showing a double-headed lamp of the third preferred embodiment according to the present invention.

The present invention further comprises a plurality of engagement heads 15 respectively engaged on two sides of the cover body 14. An opening is disposed on the engagement head 15 to allow the conductive terminal 13 to be extended out of the engagement head 15 to enable the conductive terminal 13 to be let in the retaining portion 21 of the lamp seat 2 and the conductive terminal 13 to be electrically connected to the lamp seat 2.

The engagement head 15 mentioned above may be various shapes such as circle, oval or polygon, in which polygon may be square, pentagon, hexagon or octagon.

Figure 10:
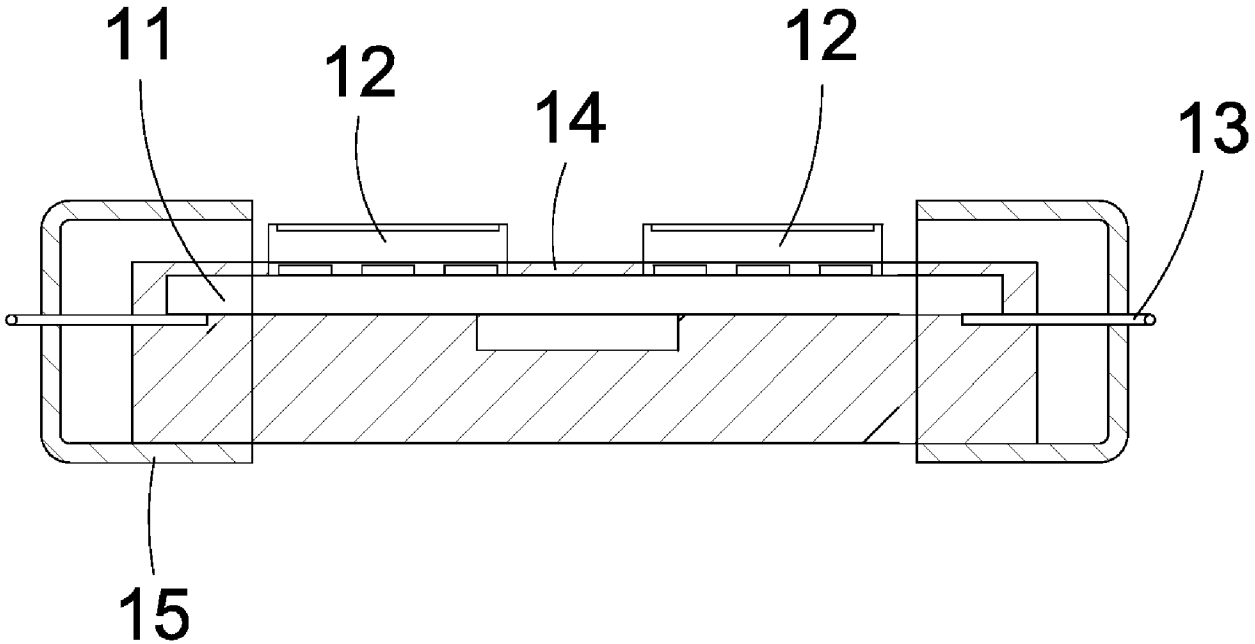
FIG. 10 is a perspective view, showing a double-headed lamp of a fourth preferred embodiment according to the present invention.

Please refer to FIG. 10. FIG. 10 is a perspective view, showing a double-headed lamp of a fourth preferred embodiment according to the present invention.

A raised mass 131 is extended out of the conductive terminal 13. A positioning hole 22 is in the retaining portion 21 of the lamp seat 2. When the raised mass 131 of the conductive terminal 13 is inserted in the positioning hole 22, the double-headed lamp 1 is allowed to be positioned in the lamp seat 2, and the double-headed lamp 1 will not fall from the lamp seat 2, even if a vibration of the lamp seat 2 occurs.

Figure 11:
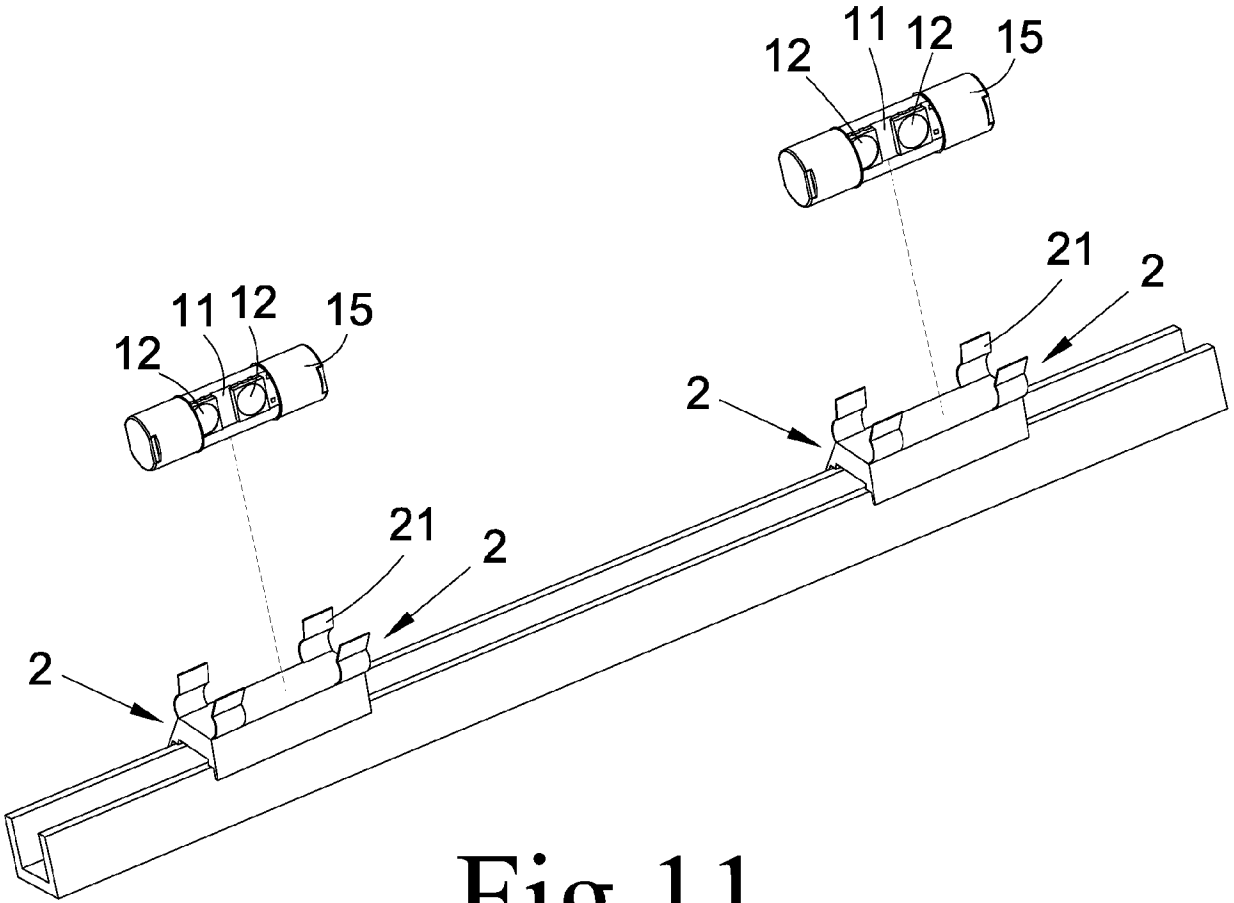
FIG. 11 is a cross sectional view, showing a double-headed lamp of a fifth preferred embodiment according to the present invention.

Please refer to FIG. 11. FIG. 11 is a cross sectional view, showing a double-headed lamp of a fifth preferred embodiment according to the present invention.

The cover body 14 is stuffed to cover a bottom of the illuminative element 12 to allow an illumination part of the illuminative element 12 to be exposed out of the cover body 14 thereby allowing light emitted from the illuminative element 12 to be not influenced by the cover body 14 to elevate the brightness. Besides, the cover body 14 may also cover the lamp board 11 and the two ends of the conductive terminal 13 completely, and the engagement heads may be respectively used to put around two sides of the cover body 14; this not only allow the conductive terminal 13 to be fixed on the lamp board 11 and not to be easily released from the lamp board 11, and may also prevent the lamp board 11 from being generated with a short circuit thereon as well as allows a user to hold the cover body 14 to be convenient to detach or assemble the double-headed lamp 1.

Besides, the cover body may also be used as a hollow body to cover a bottom of the illuminative element 12 and in the meantime, cover the lamp board 11 and the two ends of the conductive terminal 13.

Figure 12:
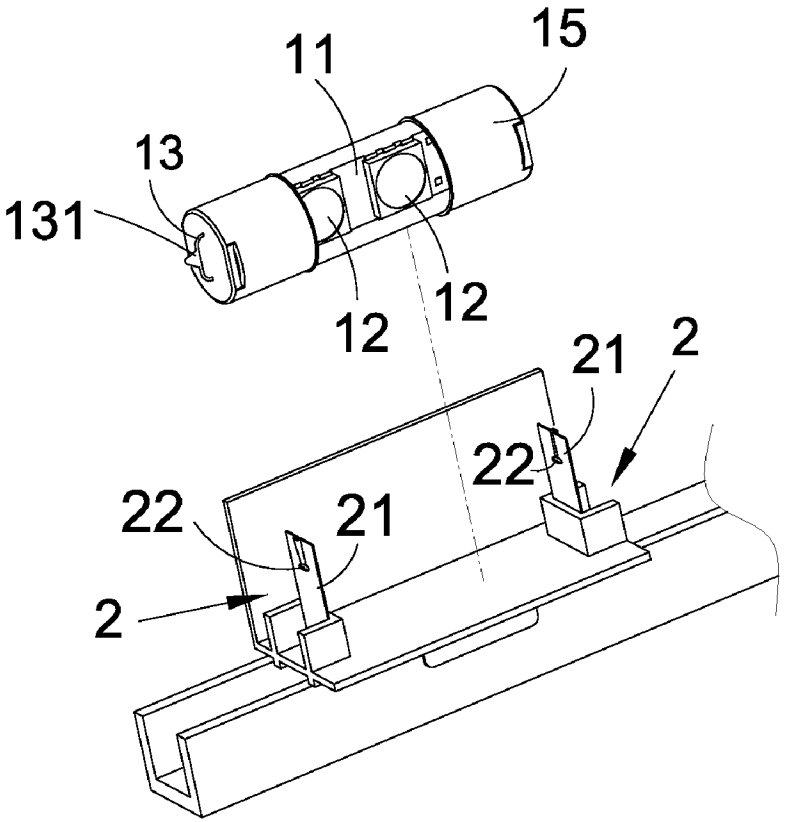
FIG. 12 is a perspective view, showing a double-headed lamp of a sixth preferred embodiment according to the present invention.

Please refer to FIG. 12. FIG. 12 is a perspective view, showing a double-headed lamp of a sixth preferred embodiment according to the present invention.

The conductive terminal 13 may also be propped against the engagement head 15 and not be extended out of the engagement head 15. Furthermore, the retaining portion 21 of the lamp seat 2 is constituted by two sheets of curvature resilient plate to allow the engagement head 15 to be guided through the resilient plate to let in the retaining portion 21 of the lamp seat 2 so as to fix the double-headed lamp 1 by using the resilient plate to clamp the engagement head 15, and allow the conductive terminal 13 to be electrically connected to the lamp seat 2.

The integrally embedded AC/DC double-headed lamp 1 according to the present invention has the following merits:

(a) the cover body 14 is integrally mad in the present invention such that the illuminative element 12 can be covered directly thereby reducing the processing time and elevating the production efficiency and in the meantime, lowering the fraction defective and further attaining to the cost reducing object;

(b) the cover body 14 is used to cover the illuminative element 11, the lamp board 11 and the two ends of the conductive terminal 11 according to the present invention so as to protect the lamp board 11, the illuminative element 12 and the connections of the lamp board 11 and the conductive terminal 13 from being damaged or released easily while being struck by an external force and prevent the lamp board 11 from being generated with a short circuit thereon;

(c) both AC and DC can be applicable to a design of the present invention such that the convenience of use can be elevated;

(d) LED or LD is used as the illuminative element 12 in the present invention; not only a high temperature will not be generated but also the merits such as high brightness, electricity saving and long life will be held;

(e) the cover body 14 made by a different material is utilized to allow the illuminative element to generate a different illumination effect so as to provide a user with different illumination and decoration uses;

(f) the cover body 14 is used to cover the bottom of the illuminative element 12 to enable the illumination part of the illuminative element 12 to be exposed out of the cover body 14 thereby allowing light emitted from the illuminative element 12 not to be influenced by the cover body 14 to elevate the brightness;

(g) a placing way of the double-headed lamp may be changed depending on a different structure of the lamp seat 2 so as to broaden the scope of application of the double-headed lamp.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An integrally embedded AC/DC double-headed lamp, comprising:

a lamp board having a first face;

at least one illuminative element, disposed on the first face of the lamp board, wherein the illuminative element is selected from a group consisting of light emitting diode (LED) and laser diode (LD);

a plurality of conductive terminals comprising at least first conductive terminal and a second conductive terminal, wherein a first end of the first conductive terminal is disposed on a first end of the lamp board, a second end of the first conductive terminal extends away from the first end of the lamp board, a first end of the second conductive terminal is disposed on a second end of the lamp board, and a second end of the second conductive terminal extends away from the second end of the lamp board, and wherein the second ends of the first and second conductive terminals are configured to mechanically and electrically connect to a lamp seat;

a cover body, made integrally and covering and sealing at least one part of the illuminative element by way of one of affusion and mold injection; and a plurality of engagement heads respectively disposed on two sides of the cover body.

2. The integrally embedded AC/DC double-headed lamp according to claim 1, wherein the lamp board comprises a AC/DC switching circuit used for judging a power supply type automatically and providing an AC or a DC power output.

3. The integrally embedded AC/DC double-headed lamp according to claim 1, comprising a plurality of illuminative elements, wherein all of the illuminative elements are disposed on the first face of the lamp board.

4. The integrally embedded AC/DC double-headed lamp according to claim 1, wherein at least the first conductive terminal is U-shaped, and two ends of the first conductive terminal are respectively electrically connected to the lamp board and a middle bended part of the first conductive terminal is electrically connected to the lamp seat.

5. The integrally embedded AC/DC double-headed lamp according to claim 1, wherein at least the first conductive terminal is long-strip-shaped, and one end of the first conductive terminal is electrically connected to the lamp board and another end is electrically connected to the lamp seat.

6. The integrally embedded AC/DC double-headed lamp according to claim 1, wherein at least the first conductive terminal is let in the lamp seat to form an electric connection.

7. The integrally embedded AC/DC double-headed lamp according to claim 1, wherein a material of the cover body is selected from a group constituted by plastics, rubber, silica gel, epoxy, PMMA and PU.

8. The integrally embedded AC/DC double-headed lamp according to claim 1, wherein the cover body is made by at least one material to allow light emitted from the illuminative element to generate a different effect.

9. The integrally embedded AC/DC double-headed lamp according to claim 1, wherein the cover body is a solid body.

10. The integrally embedded AC/DC double-headed lamp according to claim 1, wherein the cover body is a hollow body.

11. The integrally embedded AC/DC double-headed lamp according to claim 10, wherein the cover body is filled with inert gas therein.

12. The integrally embedded AC/DC double-headed lamp according to claim 1, wherein the cover body covers the lamp board.

13. The integrally embedded AC/DC double-headed lamp according to claim 1, wherein the cover body covers a part of the conductive terminal.

14. The integrally embedded AC/DC double-headed lamp according to claim 1, wherein the cover body covers a bottom of the illuminative board to allow an illumination part of the illuminative element to be exposed out of the cover body.

15. The integrally embedded AC/DC double-headed lamp according to claim 1, wherein the cover body covers the illuminative element completely.

16. The integrally embedded AC/DC double-headed lamp according to claim 1, wherein the conductive terminals are extended out of the engagement heads.

17. The integrally embedded AC/DC double-headed lamp according to claim 1, wherein the engagement heads are let in the lamp seat to allow the conductive terminals to be electrically connected to the lamp seat.

18. The integrally embedded AC/DC double-headed lamp according to claim 1, wherein the lamp board has a second face, wherein at least a first illuminative element is disposed on the first face of the lamp board and at least a second illuminative element is disposed on the second face of the lamp board.

* * * * *